US007174624B1

(12) United States Patent
Fahrion

(10) Patent No.: US 7,174,624 B1
(45) Date of Patent: Feb. 13, 2007

(54) UNIT FOR PRODUCTION OF TRACK ELEMENTS

(76) Inventor: Otmar Fahrion, Remsstr. 11, Kornwestheim (DE) 70806

( * ) Notice: Subject to any disclaimer, the term of this patent is extended or adjusted under 35 U.S.C. 154(b) by 583 days.

(21) Appl. No.: 10/169,044

(22) PCT Filed: Nov. 18, 2000

(86) PCT No.: PCT/EP00/11450

§ 371 (c)(1),
(2), (4) Date: Jun. 21, 2002

(87) PCT Pub. No.: WO01/49940

PCT Pub. Date: Jul. 12, 2001

(30) Foreign Application Priority Data

Dec. 31, 1999 (DE) ..... 199 63 979

(51) Int. Cl.
*B23P 21/00* (2006.01)

(52) U.S. Cl. ..... 29/714; 29/709

(58) Field of Classification Search ..... 29/714, 29/709, 706, 700, 720, 721, 281.1, 281.4; 318/587; 319/587
See application file for complete search history.

(56) References Cited

U.S. PATENT DOCUMENTS 5,023,534 A 6/1991 Ueda et al. ..... 318/587

FOREIGN PATENT DOCUMENTS

| | | |
|---|---|---|
| DE | 2 124 480 | 10/1972 |
| DE | 24 51 574 | 5/1976 |
| DE | 35 37 557 A1 | 4/1986 |
| DE | 195 44 557 C1 | 1/1997 |

OTHER PUBLICATIONS

"*Magneschnellbahn Transrapid—Technik und System,*" Thyssen Transrapid System GmbH, Muchen, 1997.

*Primary Examiner*—John C. Hong
(74) *Attorney, Agent, or Firm*—Factor & Lake

(57) ABSTRACT

The invention relates to a unit (10) for the production of track elements (32), comprising a number of retaining devices (14), arranged serially in the longitudinal direction of the unit. Said units each comprise a base element (20), which can be moved on wheels (34) and at least one support device (28), connected at least indirectly thereto. The above is arranged, such that a section (30, 172) of a pre-assembled track element (32) may be placed thereon, in the alignment which essentially corresponds to that of the most recent fitting position. Furthermore, the above may be positionally adjusted relative to the base element (20).

25 Claims, 5 Drawing Sheets

UNIT FOR PRODUCTION OF TRACK ELEMENTS

The present invention relates to an installation for the production of track elements.

Tracks, in particular rail tracks and here in particular rail tracks for magnetic levitation railways, are composed of individual track elements. Commercially known track elements for a magnetic levitation railway are concrete parts which are produced in situ. In order to simplify the manufacture and reduce the production costs, the track elements will in future be prefabricated in a factory as metal parts. These metal parts will then be brought to the track construction site and connected to one another there in such a way that an as far as possible continuous course of the track is produced, even in the case of varying terrain profiles. The track elements planned for a magnetic levitation railway project are, for example, 62 m long and are arranged on supports above the surface of the ground. These track elements are steel components made of thick-walled steel plate. In cross-section, these track elements have a trapezoidal box section with two transverse arms at the top in the mounting position, thus giving overall an approximately T-shaped cross-section.

Although the said track elements are all approximately the same length, they differ in terms of their detail geometry. By this is meant, for example, an individual curvature about a vertical axis (curve curvature) and about a horizontal axis running transversely to the longitudinal axis of the track element (height profile). These geometrical characteristics are individually specified for each track element in accordance with the geographical conditions at the site where the respective track element is to be laid out.

Despite the thus relatively complex and individually varying detail geometry of the individual track elements, high precision in the production is required. In the case of the said track elements, for a total length of a track element of about 62 m, a manufacturing tolerance of at most 1 mm is allowed at the joints. In order to meet these stringent precision requirements, the installations in which the individual track elements are prefabricated likewise have to meet very stringent requirements. At the same time, the installations themselves and also the production of the track elements are to be as inexpensive as possible. The track elements are firstly pre-assembled on an installation comprising clamping devices. In a further installation, the track elements are then to be machined, e.g. drilled, milled and burred.

The installation according to the invention is composed of a plurality of holding devices arranged one behind the other in the longitudinal direction of the installation and having bearing devices. The bearing devices are in each case positionally adjustable in such a way that each bearing device can be adapted to the individual geometry and position of that portion of a track element which is to be rested thereon. The bearing device is designed in such a way that the track element can be rested thereon in its orientation corresponding substantially to the subsequent mounting position. In this way, a kind of "bed" is created which reproduces the individual detail geometry of the respective track element. Owing to the adjustability, different track elements can be produced using the same installation, thereby considerably reducing the installation costs and the production costs of the individual track elements.

Advantageous developments of the invention are specified in subclaims.

One aspect of the present invention provides the preferred adjusting directions and pivot axes of the bearing devices of the holding devices of the installation.

The holding devices designed according to one aspect of the present invention are relatively robust.

A quick and reliable pivoting movement of the bearing device is provided in one aspect of the present invention.

One aspect of the present invention enables a simple vertical adjustment of the bearing device of a holding device.

The translatory adjustment of the bearing device in the lateral direction with respect to the longitudinal direction of the installation is made possible in a simple manner by the development of one aspect of the present invention, wherein relatively high vertical forces can be absorbed.

The development of one aspect of the present invention is operationally convenient and automatable.

The production of the individual "bed" in which the track element is to be produced is automated by the development of one aspect of the present invention.

In this context, the present invention is helpful in particular for increasing the precision, for the documentation and for quality assurance.

Yet another aspect of the present invention provides optimal support of the track element on the bearing element.

A still further aspect of the present invention provides a lateral guide for the track element.

Uniform bearing forces are achieved by the vertical fine-adjusting device of one aspect of the present invention.

Track elements of different widths can be received by the installation developed according to another aspect of the present invention.

It is particularly favourable to support the track element in the same way as it is supported in reality, that is via its main bearings. In addition, the track element should be stabilized in the regions between two main bearings. A corresponding development of the installation according to the invention is specified herein.

Another aspect of the present invention includes a so-called clamping and damping device which is easy to produce. Optimal conditions for the production of a track element, in particular for the machining of a track element joined together for example by spot welds, are created by the development, according to yet another aspect of the present invention. The track element is held securely and with low vibration therein.

An exemplary embodiment of the invention is now explained in detail with reference to the accompanying drawing, in which.

Figure 1:
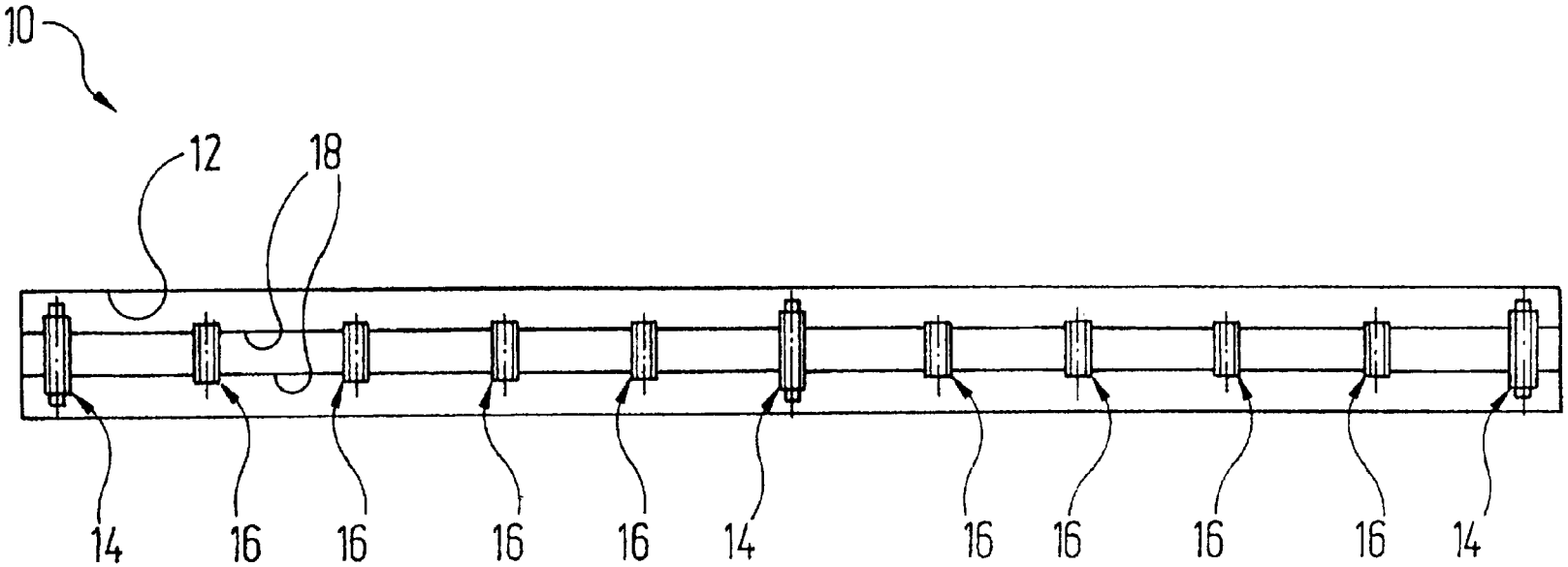
FIG. 1 shows a schematised plan view of an installation for the production of track elements having a plurality of holding devices.

An installation for the production of track elements bears, as a whole, the reference numeral 10 in FIG. 1. It comprises an elongated indentation 12 which is present in the ground, is rectangular in plan view and in which a total of 11 holding devices are arranged, distributed over its length.

The two holding devices at the respective ends of the indentation 12 and also the middle holding device are designed as a main bearing receiving device 14. The holding devices arranged between two such main bearing receiving devices 14 are designed as a clamping and damping device 16. The length of the indentation 12 is somewhat greater than the length of a track element (not illustrated in FIG. 1). The distances between the individual holding devices, i.e. the main bearing receiving devices 14 and the clamping and damping devices 16, are equal in the exemplary embodiment illustrated in FIG. 1. They may, however, also vary depending on the type of track element to be produced. For this purpose, the main bearing receiving devices 14 and the clamping and damping devices 16 are movable in the longitudinal direction of the installation 10 on rails 18, as is explained in more detail hereinbelow.

One of the main bearing receiving devices 14 is now explained in detail with reference to FIGS. 2 and 3. It goes without saying that the individual main bearing receiving devices 14 of the installation 10 can all be identical.

The main bearing receiving device 14 comprises a base element 20, a lower intermediate element 22 arranged thereon, an upper intermediate element 26 connected to the lower intermediate element 22 via a total of four vertical supporting elements 24, and two bearing devices 28 arranged above the intermediate element 26. A main bearing 30 of a pre-assembled track element 32 rests on these bearing devices in such a way that the track element 32 is oriented in accordance with its subsequent mounting position.

The base element 20 is a carriage having a total of four wheels 34 which are accommodated in wheel cases 35 and run on the rails 18 in the indentation 12. At least one of the wheels 34 is driven by an electric motor 36, so that the base element 20 can move on the rails 18. The base element 20 has an approximately rectangular basic shape in plan view and is composed of I-beams 38 and a lower cover plate 40 and upper cover plate 42. Fastened to the lower cover plate 40 is a guide piece 44 which extends in the longitudinal direction of the installation and is guided in a guide rail 46 formed from a channel section. In this way, the main bearing receiving device 14 is guided with additional security in the lateral direction as it moves on the rails 18.

Mounted on the upper cover plate 42, between the lateral wheel cases 35, is a guide part 48 which has a central ridge 50, extending transversely to the longitudinal direction of the installation, and two lateral projections 52 and 54, likewise extending transversely to the longitudinal direction of the installation. Resting on the guide part 48 is the lower intermediate element 22, which is designed as a slide and has a central groove 56 in which the central ridge 50 of the guide part 48 engages, and of which the border regions 58 and 60 at the front and rear as seen in the longitudinal direction of the installation are designed in such a way that they reach over the lateral projections 52 and 54 of the guide part 48. In this way, the lower intermediate element 22 is guided on the base element 20 such that it can be displaced in the lateral direction as seen in the longitudinal direction of the installation.

The gap between the lower intermediate element 22 and the wheel cases 35 is closed on both sides by lamellar covers 62. In order to move the intermediate element 22 relative to the base element 20 there is provided an electric motor, which, however, is not visible in the figures.

Arranged on the upper side of the base element 20, in the region of its four corners, are four electrical actuating drives 64 which act on the vertical supporting elements 24 so that the latter can be vertically displaced. The electrical actuating drives 64 are connected via shafts 66 to a central positive synchronising gear 68 arranged centrally on the lower intermediate element 22. In this way, it is ensured that the vertical supporting elements 24 move linearly and with an identical travel in each case.

On the lower intermediate element 22 there are provided, furthermore, guide blocks 70 which are likewise arranged in the region of its corners and in which vertical guide rods 72 fastened to the upper intermediate element 26 are guided. The vertical movement of the vertical supporting elements 24 and of the guide rods 72 downwards is made possible by openings, not visible in the figure, in the upper cover plate 42 of the base element 20.

The upper intermediate element 26 is composed, in a similar fashion to the base element 20, of I-beams 74 running in the longitudinal and transverse direction, of a lower cover plate 76 and of an upper cover plate 78. The space extending between upper intermediate element 26 and lower intermediate element 22 is closed laterally by folding walls 80 which are flexible in the vertical direction.

A base plate 82 for the bearing devices 28 rests on the upper cover plate 78 of the upper intermediate element 26. This base plate has a central bearing bush 84, in which a bearing pin 86 firmly welded to the upper cover plate 78 of the upper intermediate element 26 engages. In this way, the base plate 82 is pivotable relative to the upper intermediate element 26 about a vertical axis. The sliding movement of the base plate 82 relative to the upper cover plate 78 of the upper intermediate element 26 is facilitated here by sliding bearings, not visible in the figures. The movement itself is brought about by an electric motor 88 which drives a shaft 90.

Mounted on the base plate 82, in the vicinity of its lateral borders as seen in the longitudinal direction of the installation, are two guide plates 92 which constitute the lowermost element of the respective bearing device 28 and in the horizontal borders, extending transversely to the longitudinal direction of the installation, of which a groove 94 is made in each case. Lateral guide portions 96 of a slide 98 engage in each of these grooves. The slide 98 carries an electric motor 100 which drives a spindle 102 which, in turn, cooperates with a threaded portion 104 of the corresponding guide plate 92. In this way, the slides 98 can be moved independently of each other relative to the guide plates 92 in the lateral direction as seen in the longitudinal direction of the installation.

A circular-segment-shaped recess 106 is made in the upper borders of the two slides 98, in which recess a complementary bearing portion 108 of a bearing element 110 is mounted in each case. Rolling or sliding bearings may be present along the boundary surface of the circular-segment-shaped recess 106, which facilitate the movement of the bearing portion 108 of the bearing element 110 relative to the recess 106 of the slide 98. This allows free movement of the two bearing elements 110 relative to the respective slide 98 about an axis running transversely and horizontally as seen in the longitudinal direction of the installation.

The upper region of each bearing element 110 has a flat bearing plate 112 and a lateral side portion 116 with a sloping lead-in portion 114. The vertical distance of the bearing plate 112 from the bearing portion 108 of each bearing element 110 can be set by an electric motor 118 in a manner not shown specifically in the figures. The main bearings 30 of the track element 32 rest on the bearing plates 112 of the two bearing elements 110.

Figure 2:
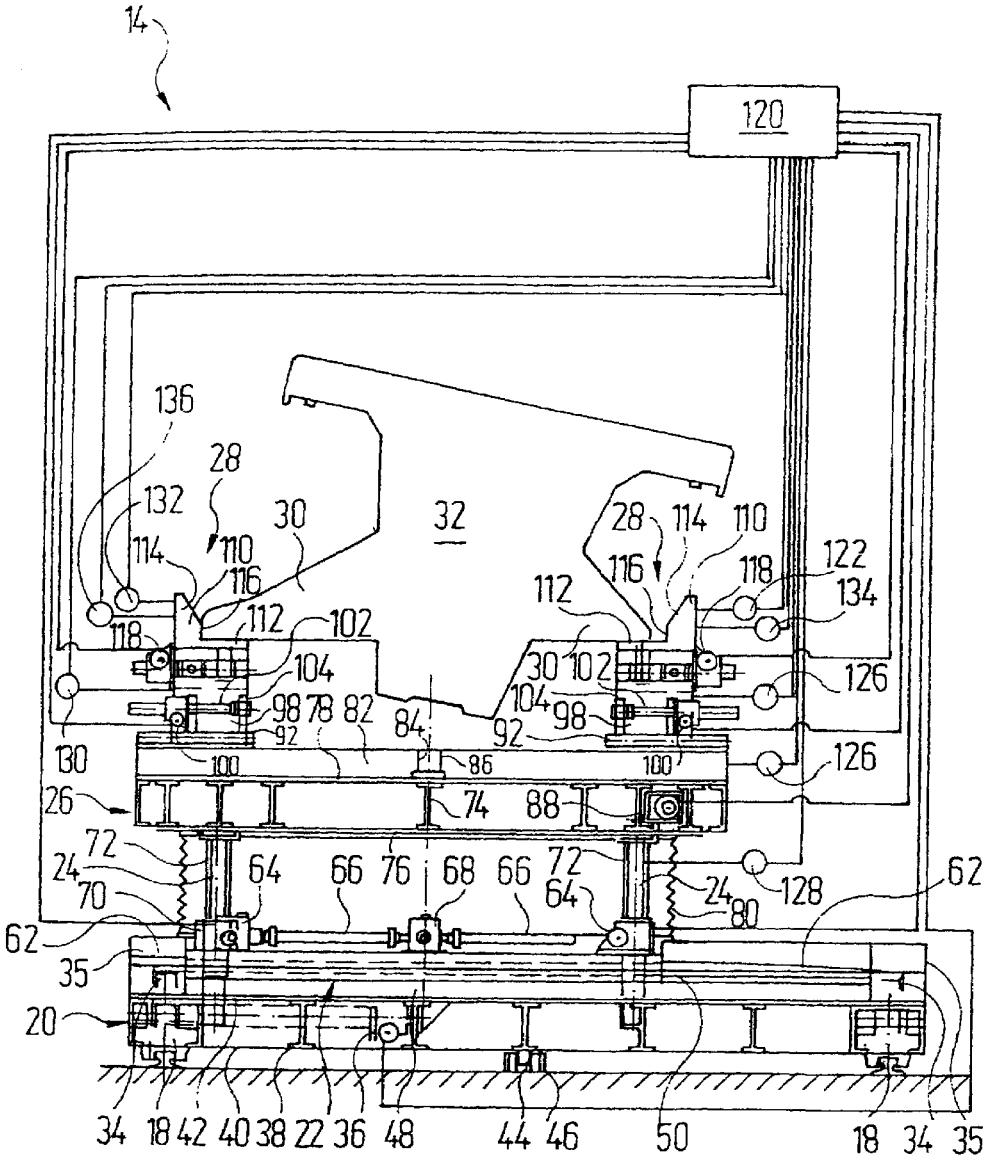
FIG. 2 shows a schematised and partially sectioned front view of one of the holding devices of FIG. 1 which is designed as a main bearing receiving device.
Figure 3:
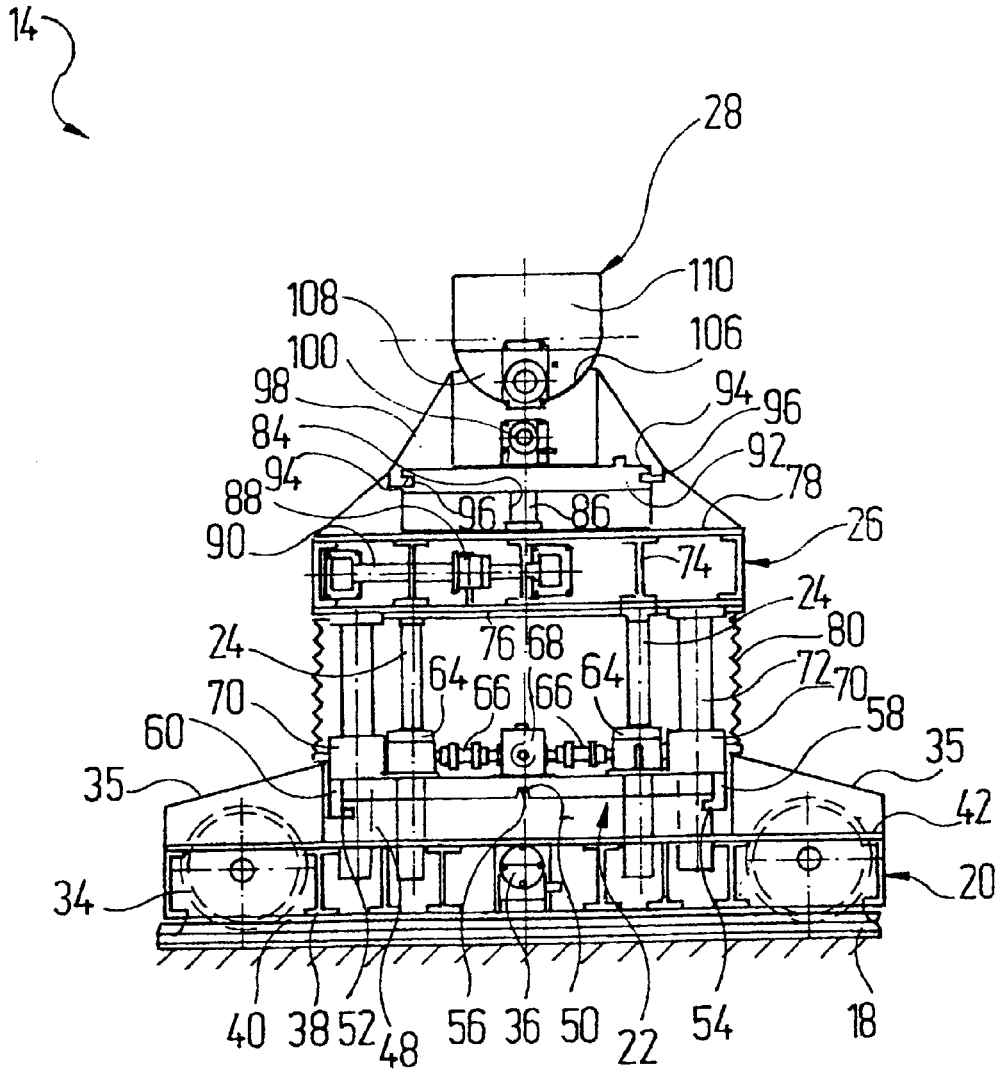
FIG. 3 shows a schematised and partially sectioned side view of the main bearing receiving device of FIG. 2.

Illustrated in FIG. 2, furthermore, is a data acquisition and control unit 120 which controls the various electric motors and receives signals from position sensors 122, 124, 126, 128, 130 and 132 at the electric motors and also from force transducers 134 and 136 which detect the bearing forces at the two bearing elements 110.

Figure 4:
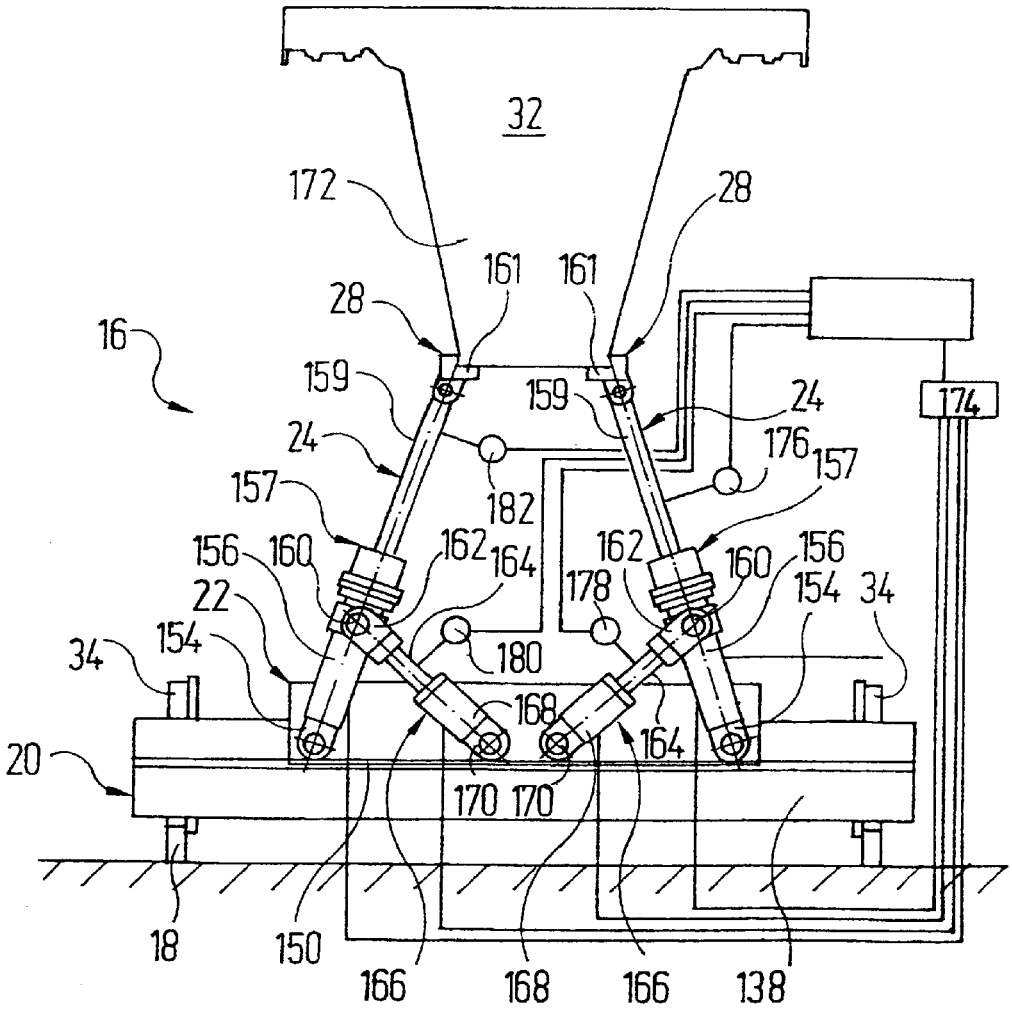
FIG. 4 shows a schematised and partially sectioned front view of one of the holding devices of FIG. 1 which is designed as a clamping and damping device.
Figure 5:
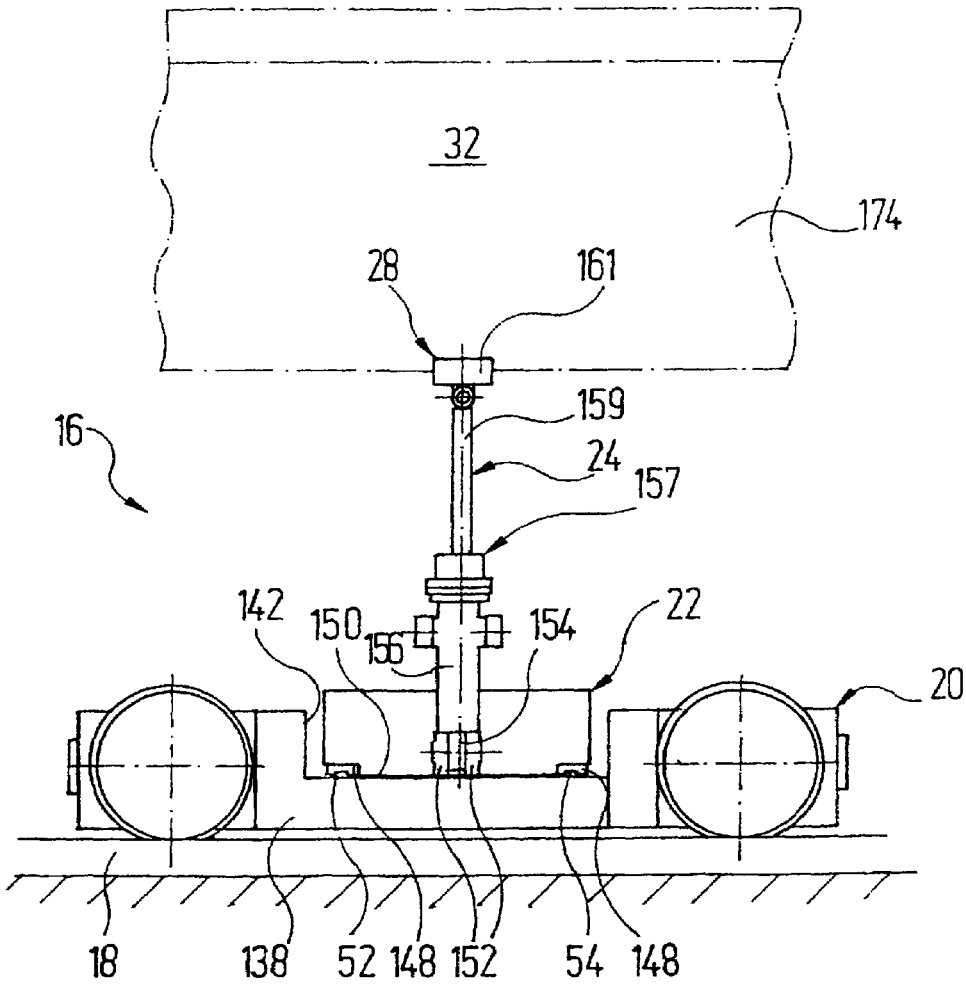
FIG. 5 shows a side view of the clamping and damping device of FIG. 4.

The clamping and damping devices 16 are now explained in detail with reference to FIGS. 4 and 5, where parts which are functionally identical to the main bearing receiving device described above generally bear the same reference numerals:

Each clamping and damping device 16 comprises a base element 20 which is designed as a carriage movable on the rails 18 and has four wheels 34. This carriage 20 is driven by an electric motor, not visible in the figures.

Substantially horizontal rails 52 and 54 running transversely to the longitudinal direction of the installation are arranged in a central recess 142 of the carriage 20. An intermediate element 22 designed as a slide is displaceably mounted on these rails via guide pieces 148. The intermediate element 22 can also be moved by an electric motor, not visible in the figures.

The intermediate element 22 has an upwardly open trough-shaped form with a bottom plate 150. Formed on the latter are four clevis straps 152 which are arranged in a line extending transversely to the longitudinal direction of the installation and define pivot axes extending in the longitudinal direction of the installation. Two of these bearing straps 152 are arranged in the vicinity of the lateral border of the intermediate element 22. A connecting portion 154 of a cylinder housing 156 of a hydraulic cylinder 157 is pivotably held in each of these straps via a pin 158. The hydraulic cylinders 157 each comprise piston rods 159 and form vertical supporting elements 24. The upper ends of the piston rods 159 each carry a bearing device 28 which is designed, in the present case, as a bearing angle.

Formed on the upper ends of each of the cylinder housings 156 are bearing journals 160 which extend in the longitudinal direction of the installation. Clevis straps 162 engage in the bearing journals 160 and are, in turn, each mounted onto the distal end of the piston rod 164 of a hydraulic cylinder 166. The cylinder housing 168 of the latter in turn has a connecting portion 170 which is respectively connected to one of the inner bearing straps 152 on the bottom plate 150. The hydraulic cylinders 157 and 166 are held in a manner resistant to tilting by the bearing straps 152 and the connecting portions 154 and 170.

The hydraulic cylinders 166 enable the setting of the angle between the hydraulic cylinders 157 and the plane of the bottom plate 150, and consequently the lateral position of the bearing angles 161.

The hydraulic cylinders 157 and 166 are connected to a valve block 174 which in turn is controlled by the control and data acquisition device 120. The latter also receives signals from position and displacement sensors 176, 178, 180 and 182, by which the actual travel of the hydraulic cylinders 157 and 166 is indicated.

The installation 10 is operated as follows:

Firstly, in order to set the main bearing receiving devices 14:

The individual setting data stored in a memory of the control and data acquisition device 120 are retrieved for each of the three main bearing receiving devices 14 of the installation 10 for the individual track element 32 to be produced. Then, the electrical actuating drives 64 of the vertical supporting elements 24 are controlled by the control and data acquisition device 120 in such a way that the vertical supporting elements are displaced vertically and move the upper intermediate element 26 and the bearing device 28 into the desired vertical position. In the process, the positive synchronising gear 68 ensures that the travel of the vertical supporting elements 24 is equal, i.e. the upper intermediate element 26 is aligned parallel to the lower intermediate element 22 in every vertical position. The electric motors 88 of the main bearing receiving devices 14 are controlled, furthermore, by the control and data acquisition device 120 in such a way that the base plate 82 of the respective bearing devices 28 pivots into the desired position about the vertical axis defined by the bearing pin 86.

In the same way, the electric motors 100 of the respective main bearing receiving devices 14 are also controlled in such a way that the distance between the bearing elements 110 of the respective main bearing receiving device 14 corresponds to the individual main bearing 30 of the respective track element 32.

It is possible to check the actual settings of the various electrical actuating elements by means of the displacement sensors 122 to 132, which indicate the current positions of the actuating elements of the control and data acquisition device 120. This is particularly helpful for achieving the desired high manufacturing precision and on account of the quality assurance requirements.

Once the settings have been carried out, the track element 32 corresponding to this setting is lowered from above in such a way that the main bearings 30 come to rest on the bearing plates 112 of the bearing elements 110 of the three main bearing receiving devices 14 of the installation 10.

The bearing loads of each bearing element 110 are individually determined by the force transducers 134 and 136. The electric motors 118 of each bearing element 110 are then controlled by the control and data acquisition device 120, and consequently the height of the bearing plates 112 of the respective bearing elements 110 finely adjusted, in such a way that the desired distribution of the bearing forces exists.

Then, the valve block 174 of the control and data acquisition device 120 is controlled in such a way that the hydraulic cylinders 157 and 166 of the total of eight clamping and damping devices 16 are moved into the position corresponding to the course of the individual track element 32, in which the respective bearing angles 161 engage on the base body 172 of the track element 32. In this way, the portion of the track element 32 lying between two main bearing receiving devices 14 is additionally supported. This has the advantage that vibrations of the track element 32 which occur as a result of the machining of the pre-assembled track element 32 are damped or in some cases completely suppressed, thereby increasing the production precision.

In an exemplary embodiment (not illustrated), the rails 18 extend through different machining stations, so that the "train" formed from the three main bearing receiving devices 14, the eight clamping and damping devices 16 and the track element 32 can be moved to and fro as a whole between machining stations or setting-up stations.

The settings outlined may be carried out individually for each of the main bearing receiving devices 14 and clamping and damping devices 16, so that a track element 32 can be produced or machined with a specific curve curvature.

It goes without saying that pneumatic or manual actuating devices may also be used instead of electrical or hydraulic actuating elements.

The installation described may be employed not only for the aforementioned machining of the track element but also for its final measurement.

The position assumed by the various actuating elements may allow, in anticipatory fashion, for the distortion which results during the machining of the track element, thus automatically compensating for the distortion.

The invention claimed is:

1. An installation for the production of track element comprising a plurality of holding devices arranged one behind the other in a direction of the installation, which each comprise a base element movable on wheels, and at least one bearing device which is connected at least indirectly to the base element and configured in such a way that the portion of a pre-assembled track element can be rested thereon in an orientation substantially corresponding to a subsequent mounting position, and which is positionally adjustable relative to the base element, wherein one of the holding devices comprises at least one of hydraulic and electrical actuator, which bring about appropriate movements and there is provided a control unit with a memory which control unit generates signals and is connected to the actuators, and which data for a specific track element being stored in the memory to control movement of the actuators in the appropriate positions, and further wherein the bearing device of at least one holding device is pivotable about a substantially vertical axis.

2. An installation according to claim 1, characterized in that the bearing device of at least one holding device is held on an upper intermediate element movable relative to the base element.

3. An installation according to claim 2, characterized in that the bearing device of at least one holding device is pivotable relative to the upper intermediate element about its substantially vertical axis.

4. An installation according to claim 1, characterized in that at least one of the holding devices comprises spaced-apart lengthwise-adjustable supporting elements which are connected on the one hand to the base element and on the other hand at least indirectly to the bearing device and via which a vertical adjustment of the bearing device of the holding device is effected.

5. An installation according to claim 1, wherein the installation has a longitudinal axis, characterized in that at least one of the holding devices comprises guides and slides cooperating therewith, which enable adjustment of the position of the bearing device in a direction substantially transversely to the longitudinal axis of the installation.

6. An installation according to claim 1, characterized in that the actuators comprise electrical self-locking spindle drives.

7. An installation according to claim 1, characterized in that in at least one of the holding devices there are provided sensors which detect the position of the bearing device and emit an appropriate signal to the control unit which, in turn, has a comparator device which compares detected values with desired values stored in the memory, a warning message being generated if the detected values and the desired values differ from one another by more than a specified value.

8. An installation according to claim 1, wherein the installation has a longitudinal axis, characterized in that the bearing device of at least one of the holding devices comprises at least one bearing element which is pivotable about a substantially horizontal axis running transversely to the longitudinal axis of the installation.

9. An installation according to claim 8, characterized in that the bearing element comprises at least one of a lateral stop and a clamping jaw.

10. An installation according to claim 8, characterized in that a fine-adjusting device is provided, by means of which height of the bearing element can be individually set relative to the base element.

11. An installation according to claim 8, characterized in that at least two bearing elements are provided, the mutual distance of which is variable.

12. An installation according to claim 1, characterized in that a plurality of holding devices are designed as main bearing receiving devices, on the bearing device of which a main bearing of a track element oriented in the mounting position can be rested, and at least one of the holding devices is designed as a clamping and damping device, on the bearing device of which a portion of a base body of a track element oriented in the mounting position can be rested.

13. An installation according to claim 12, wherein the installation has a longitudinal axis, characterized in that the bearing device of the clamping and damping device is fastened in an articulated manner to a first actuator, which is connected to the base element in such a manner as to be articulated about an axis running substantially in the longitudinal direction of the installation and on which a second actuator acts, by means of which an angle between the first actuator and the base element can be set.

14. An installation according to claim 12, characterized in that at least one, preferably four, clamping and damping devices are arranged between two main bearing receiving devices.

15. An installation for the production of track elements having a plurality of holding devices arranged one behind the other in a direction of the installation, which each comprise a base element movable on wheels, and at least one bearing device which is connected at least indirectly to the base element and configured in such a way that a portion of a pre-assembled track element can be rested thereon in an orientation substantially corresponding to a subsequent mounting position, and which is positionally adjustable relative to the base element characterized in that at least one of the holding devices comprises at least one of hydraulic and electrical actuators, which bring about appropriate movements, and in that there is provided a control unit with a memory, which control unit generates signals and is connected to the actuators, such that the actuators are movable into the appropriate positions in dependence on data stored in the memory for a specific track element wherein the bearing device of at least one holding device is pivotable about a substantially vertical axis and further wherein the bearing device of at least one holding device is held on an upper intermediate element movable relative to the base element.

16. An installation according to claim 15, characterized in that the bearing device of at least one holding device is pivotable relative to the upper intermediate element about its substantially vertical axis.

17. An installation according to claim 16, characterized in that at least one of the holding devices comprises spaced-apart lengthwise-adjustable supporting elements which are connected on the one hand to the base element and on the other hand at least indirectly to the bearing device and via which a vertical adjustment of the bearing device of the holding device is effected.

18. An installation according to claim 17, characterized in that the actuators comprise electrical self-locking spindle drives.

19. An installation according to claim 18, characterized in that in at least one of the holding devices there are provided sensors which detect the position of the bearing device and emit an appropriate signal to the control unit which, in turn, has a comparator device which compares detected values with desired values stored in the memory, a warning message being generated if the detected values and the desired values differ from one another by more than a specified value.

20. An installation according to claim 19, characterized in that the bearing element comprises at least one of a lateral stop and a clamping jaw.

21. An installation according to claim 20, characterized in that a fine-adjusting device is provided, by means of which height of the bearing element can be individually set relative to the base element.

22. An installation according to claim 21, characterized in that at least two bearing elements are provided, the mutual distance of which is variable.

23. An installation according to claim 22, characterized in that a plurality of holding devices are designed as main bearing receiving devices, on the bearing device of which a main bearing of a track element oriented in the mounting position can be rested, and at least one of the holding devices is designed as a clamping and damping device, on the bearing device of which a portion of a base body of a track element oriented in the mounting position can be rested.

24. An installation according to claim 23, wherein the installation has a longitudinal axis, characterized in that the bearing device of the clamping and damping device is fastened in an articulated manner to a first actuator, which is connected to the base element in such a manner as to be articulated about an axis running substantially in the longitudinal direction of the installation and on which a second actuator acts, by means of which an angle between the first actuator and the base element can be set.

25. An installation according to claim 24, characterized in that at least one, preferably four, clamping and damping devices are arranged between two main bearing receiving devices.

* * * * *